US007081859B2

(12) United States Patent
Miyoshi et al.

(10) Patent No.: US 7,081,859 B2
(45) Date of Patent: Jul. 25, 2006

(54) ANTENNA UNIT HAVING A WIDE BAND

(75) Inventors: Akira Miyoshi, Kanagawa (JP); Hisamatsu Nakano, Tokyo (JP)

(73) Assignees: Mitsumi Electric Co., Ltd., Tokyo (JP); Hisamatsu Nakano, Tokyo (JP)

( * ) Notice: Subject to any disclaimer, the term of this patent is extended or adjusted under 35 U.S.C. 154(b) by 15 days.

(21) Appl. No.: 10/874,910

(22) Filed: Jun. 22, 2004

(65) Prior Publication Data

US 2005/0062662 A1 Mar. 24, 2005

(30) Foreign Application Priority Data

Sep. 18, 2003 (JP) ..... 2003-325858

(51) Int. Cl.
*H01Q 13/10* (2006.01)
*H01Q 1/38* (2006.01)

(52) U.S. Cl. ..... 343/767; 343/700 MS; 343/873

(58) Field of Classification Search ..... 343/700 MS, 343/770, 767, 873
See application file for complete search history.

(56) References Cited

U.S. PATENT DOCUMENTS 4,605,012 A * 8/1986 Ringeisen et al. ..... 607/155
5,828,340 A * 10/1998 Johnson ..... 343/700 MS
6,249,254 B1 * 6/2001 Bateman et al. ..... 343/700 MS
6,329,961 B1 * 12/2001 Mandai et al. ..... 343/873
6,741,212 B1 * 5/2004 Kralovec et al. .... 343/700 MS
6,917,334 B1 * 7/2005 Chen ..... 343/700 MS
2002/0105479 A1 * 8/2002 Hamada et al. ..... 343/895
2003/0098815 A1 * 5/2003 Teshirogi et al. ..... 343/772

FOREIGN PATENT DOCUMENTS

JP 7-94934 A 4/1995
JP 10-190347 A 7/1998

* cited by examiner

*Primary Examiner*—Don Wong
*Assistant Examiner*—Leith Al-Nazer
(74) *Attorney, Agent, or Firm*—Frishauf, Holtz, Goodman & Chick, P.C.

(57) ABSTRACT

A UWB antenna has an upper dielectric, a lower dielectric, and a conductive pattern sandwiched therebetween. The conductive pattern has a feeding point at a substantially center portion of a front surface. The conductive pattern has a reversed triangular portion having a right-hand taper part and a left-side taper part which widen from the feeding point at a predetermined angle toward a right-hand side surface and a left-hand side surface, respectively, and a rectangular portion having a base side being in contact with an upper side of the reversed triangular portion. The rectangular portion may preferable have at least one slit formed therein.

5 Claims, 6 Drawing Sheets

ANTENNA UNIT HAVING A WIDE BAND

This application claims priority to prior Japanese patent application JP 2003-325858, the disclosure of which is incorporated herein by reference.

BACKGROUND OF THE INVENTION

This invention relates to an antenna unit and, more particularly, to an antenna for an ultra wideband (UWB).

The UWB technology means an ultra wideband radio technology like its name and is defined as any radio technology having a spectrum that occupies a bandwidth greater than 25 percent of the center frequency, or a bandwidth of at least 1.5 GHz. In a word, the UWB technology is technology for communicating using short pulses (normally each having a pulse width of 1 ns or less) of ultra wideband so as to start a revolution in radio technology.

A crucial difference between a conventional radio technology and the UWB technology is the presence or absence of a carrier wave. The conventional radio technology modulates a sinusoidal wave having a frequency called the carrier wave using various methods to transmit and receive data. On the other hand, the UWB technology does not the carrier wave. In the manner which is written in definition of the UWB technology, the UWB technology uses the short pulses of the ultra wideband.

Like its name, the UWB technology has a frequency band of the ultra wideband. On the other hand, the conventional radio technology has only a narrow frequency band. This is because it is possible for the narrow frequency band to put electric waves to practical use. The electric waves are a finite resource. The reason whey the UWB technology is widely noticed in spite of the ultra wideband is output energy of each frequency. The UWB technology has a vary small output each frequency in place of a wide frequency band. Inasmuch as the output of the UWB technology has magnitude so as to be covered with noises, the UWB technology reduces interference with other wireless spectra. In the United States, the Federal Communications Commission (FCC) has mandated that UWB radio transmissions can legally operate in range from 3.1 GHz up to 10.6 GHz, at a limited transmit power of −4.1 dBm/MHz.

In addition, antennas basically use a resonance phenomenon. The antenna has a resonance frequency which is determined by its length, it is difficult for the UWB including a lot of frequency components to make the antenna for UWB resonate. Accordingly, the wider the frequency band of the electric wave to be transmitted is, the more difficult it makes a plan for the antenna for UWB.

For example, patch antennas are known as small-sized antennas in the art. As one of the patch antennas, a compact plane patch antenna is disclosed, for example, in JP 07-094934 A. According to JP 07-094934 A, the compact plane patch antenna has high infrequency temperature characteristics and high reliability by using magnesium tinanate ceramic having comparatively high dielectric constant as a main material for a dielectric material and adding the proper quantity of lithium niobate, alumina, manganese oxide, etc., individually or their combination at ions to the main material to mold the antenna. In addition, a patch antenna device capable of coping with a plurality of frequencies is known, for example, in JP 10-190347 A.

However, the patch antennas are unsuitable for the UWB antennas because the patch antennas have no wideband.

On the other hand, Taiyo Yuden Co. Ltd. has successfully developed a very miniaturized ceramic chip antenna having a size of 10×8×1 mm for ultra wideband applications. Since UWB technology was released by the FCC for commercial use, it has been hailed as the short-range wires-communication standard of the future. For one thing, it promises to simultaneously provide a high data rate and low power consumption. By sending very low-power pulses below the transmission-noise threshold, UWB also avoids interference. By developing the antenna, is has become the responsibility of the wireless industry to help UWB make the transition from military applications to widespread commercial use for connecting at a very high speed data between digital devices such as PDP (plasma display panel) television, a digital camera, or the like.

In addition, such a UWB antenna can be used for various purposes such as Bluetooth (registered trademark), wireless LAN (local area network), or the like.

Bluetooth (registered trademark) technology is a cutting-edge open specification that enables short-range wireless connections between desktop and notebook computers, handhelds, personal digital assistants, mobile phones, camera phones, printers, digital cameras, handsets, keyboards and even a computer mouse. Bluetooth wireless technology uses a globally available frequency band (2.4 GHz) for worldwide compatibility. In a nutshell, Bluetooth technology unplugs your digital peripherals and makes cable clutter a thing of the past.

The wireless LAN is an LAN using a transmission path except for a wire cable, such as electric waves, infrared rays, or the like.

In the manner which is described above, the conventional antenna such as a patch antenna is disadvantageous in that it is difficult to widen the band and wave distortions (wave expansion) occur.

SUMMARY OF THE INVENTION

It is therefore an object of the present invention to provide an antenna unit which is capable of widening the band.

It is another object of the present invention to provide an antenna unit which is capable of improving a frequency characteristic.

Other objects of this invention will become clear as the description proceeds.

According to a first aspect of this invention, an antenna unit comprises an upper dielectric, a lower dielectric, and a conductive pattern sandwiched between the upper dielectric and the lower dielectric. The conductive pattern has a feeding point at a substantially center portion of a front thereof. The conductive pattern comprises a reversed triangular portion having a right-hand taper part and a left-side taper part which widen from the feeding point at a predetermined angle toward a right-hand side and a left-hand side, respectively, and a rectangular portion having a base side being in contact with an upper side of the reversed triangular portion.

In the antenna unit according to the first aspect of this invention, the predetermined angle may preferably lie in a range between 40 degrees and 60 degrees. In addition, the rectangular portion may desirably have at least one slit formed therein. The rectangular portion may have two or more slits.

According to a second aspect of this invention, an antenna unit comprises an upper dielectric, a lower dielectric, and a conductive pattern sandwiched between the upper dielectric and the lower dielectric. The conductive pattern has a feeding point at a substantially center portion of a front thereof. The conductive pattern comprises a reversed triangular portion having a right-hand taper part and a left-side taper part which widen from the feeding point at a predetermined angle toward a right-hand side and a left-hand side, respectively, and a semicircular portion having a base side being in contact with an upper side of the reversed triangular portion.

In the antenna unit according to the second aspect of this invention, the predetermined angle may preferably lie in a range between 40 degrees and 60 degrees. In addition, the semicircular portion may desirably have at least one slit formed therein. The semicircular portion may have two or more slits.

DESCRIPTION OF THE PREFERRED EMBODIMENTS

Figure 1B:
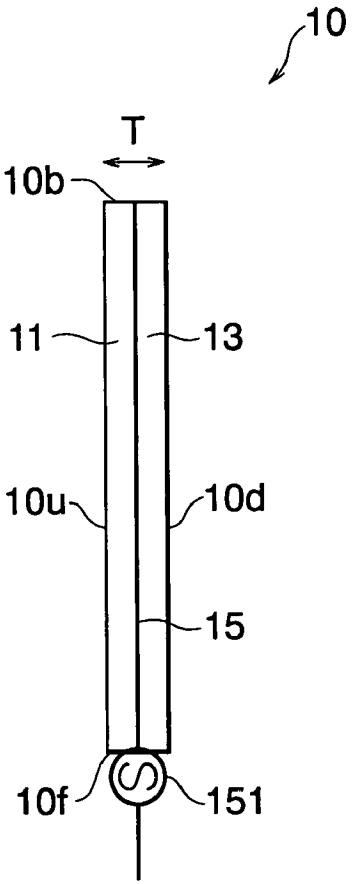
FIG. 1B is a vertical sectional side view of the antenna unit illustrated in FIG. 1A.
Figure 1A:
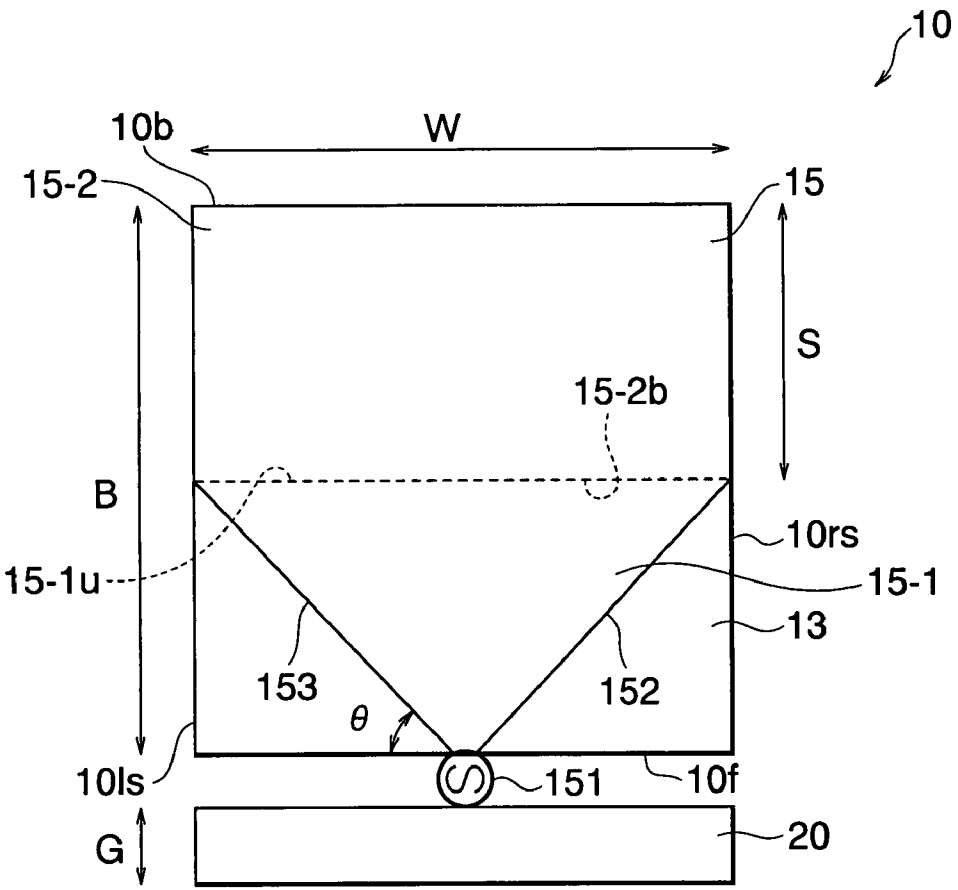
FIG. 1A is a transverse sectional plan view of an antenna unit according to a first embodiment of this invention.

Referring to FIGS. 1A and 1B, the description will proceed to a UWB antenna 10 as an antenna unit according to a first embodiment of the present invention. FIG. 1A is a transverse sectional plan view of the UWB antenna 10. FIG. 1B is a vertical sectional side view of the UWB antenna 10.

The UWB antenna 10 has, as whole exterior appearance, configuration of a rectangular parallelepiped (rectangular plate) having a length B, a width W, and a thickness T. In the example being illustrated, the length B is equal to 22 mm, the width W is equal to 21.6 mm, and the thickness T is equal to 0.8 mm.

The UBW antenna 10 has an upper surface 10*u*, a bottom surface 10*d*, a front surface 10*f*, a back surface 10*b*, a right-hand side surface 10*rs*, and a left-hand side surface 101*s*.

The UWB antenna 10 comprises an upper rectangular dielectric 11, a lower rectangular dielectric 13, and a conductive pattern 15 sandwiched between the upper rectangular dielectric 11 and the lower rectangular dielectric 13. Each of the upper rectangular dielectric 11 and the lower rectangular dielectric 13 has a length B, a width W, and a thickness or height T/2. The conductive pattern 15 is made of material, for example, of silver paste and has a thickness of about 8 μm.

In addition, the upper rectangular dielectric 11 and the lower rectangular dielectric 13 have relative dielectric constant $\epsilon r$. In the example being illustrated, the relative dielectric constant $\epsilon r$ is equal to 4.4. Each of the upper rectangular dielectric 11 and the lower rectangular dielectric 13 comprises, for example, a ceramic plate.

The conductive pattern 15 has a feeding point 151 at a substantially center portion of the front surface 10*f*. The conductive pattern 15 has a right-hand taper part 152 and a left-hand taper part 153 which widen from the feeding point 151 at a predetermined angle θ toward the right-hand side surface 10*rs* and the left-hand side surface 101*s*, respectively. In the example being illustrated, the predetermined angle θ is equal to 45 degrees.

That is, the conductive pattern 15 comprises a reversed triangular portion 15-1 formed at the front surface 10*f* side and a rectangular portion 15-2 formed at the back surface 10*b* side. The reversed triangular portion 15-1 has the right-hand taper portion 152, the left-hand taper portion 153, and an upper side 15-1*u*. The rectangular portion 15-2 has a base side 15-2*b*. The upper side 15-1*u* of the reversed triangular portion 15-1 and the base side 15-2*b* of the rectangular portion 15-2 are in contact with each other. The rectangular portion 15-2 has a length S and a width W while the reversed triangular portion 15-1 has a height (B−S). In the example being illustrated, the length S is equal to 0.8 mm.

The feeding point 151 of the conductive pattern 15 is electrically connected to a ground part 20 which has a length G and a width W. In the example being illustrated, the length G is equal to 0.8 mm.

Figure 2:
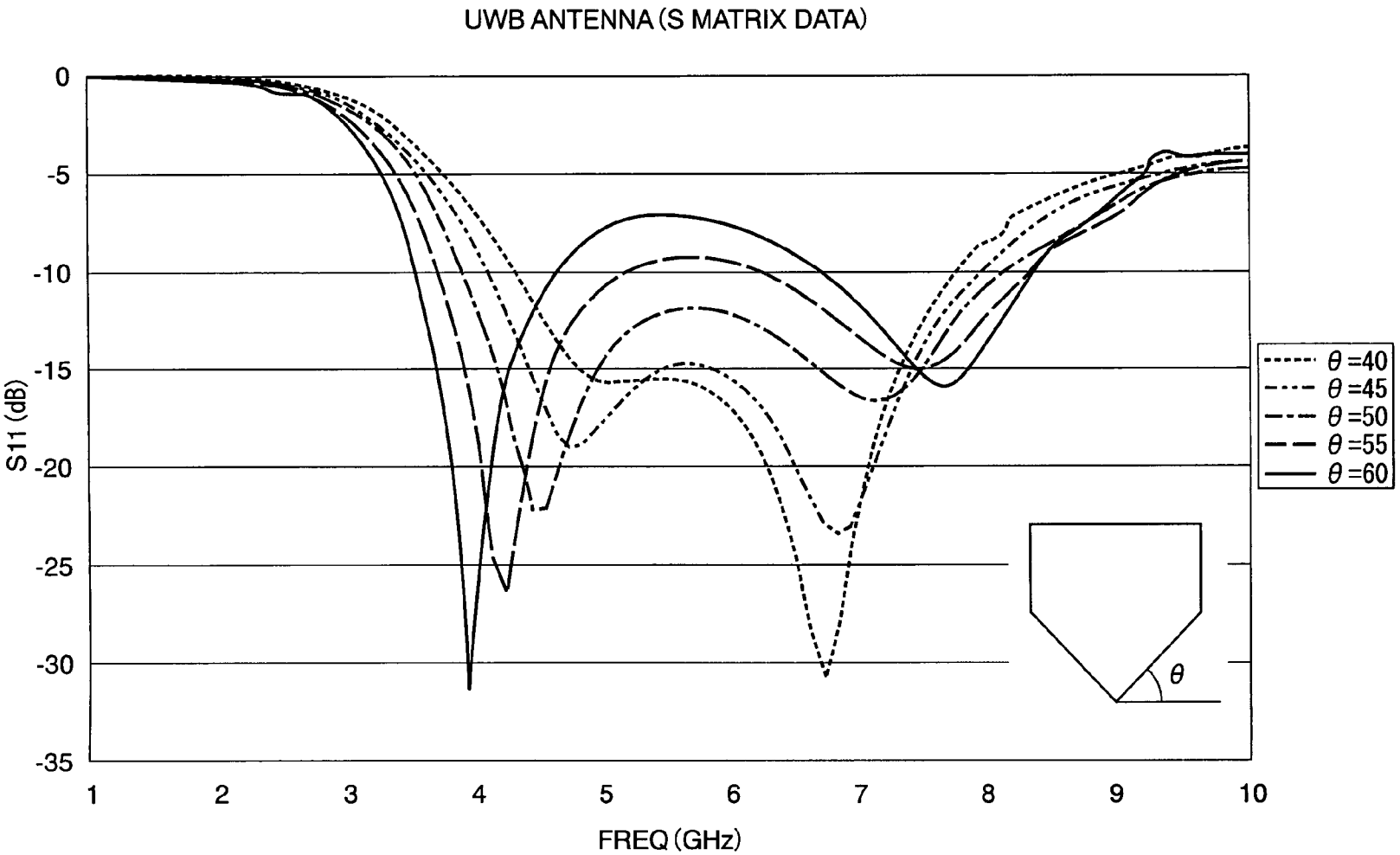
FIG. 2 is a characteristic view showing antenna characteristics when an angle of the antenna unit 10 illustrated in FIGS. 1A and 1B is changed.

FIG. 2 shows antenna characteristics when the angle θ of the UWB antenna 10 illustrated in FIGS. 1A and 1B is changed. In FIG. 2, the abscissa represents a frequency (GHz) and the ordinate represents S11 (dB) of S parameters.

The S parameters are defined by a following expression (1):

$$\begin{pmatrix} b1 \\ b2 \end{pmatrix} = \begin{pmatrix} S11 & S12 \\ S21 & S22 \end{pmatrix} \begin{pmatrix} a1 \\ a2 \end{pmatrix}$$

where a1 and a2 represent input voltages and b1 and b2 represent reflected voltages. From the expression (1), S11 and S21 can be calculated when a2=0 in the expression (1) and S12 and S22 can be calculated when a1=0 in the expression (1). S11 and S22 represent reflection characteristics and S12 and S21 represent transmission characteristics. Inasmuch as the S parameters are represented by the ratios of the input voltages to the reflected voltages, it is possible to easily calculate the S parameters in also a micro wave band.

That is, S11 in the S parameters represents a reflection coefficient. When the reflection coefficient S11 is small, it indicates that matching is achieved as the antenna.

It will be assumed, for example, that it is required that the reflection coefficient S11 is −10 dB or less. In this event, the angle θ of 60 degrees and 55 degrees are not preferable because the reflection coefficient S11 is −10 dB or more in a frequency range between 5-6 GHz when the angle θ is 60 degrees or 55 degrees. The reflection coefficient S11 is less than −10 dB when the angle θ is 50 degrees, 45 degrees, or 40 degrees. When the angle θ is equal to 40 degrees, a frequency band width less than −10 dB is narrow. When angle θ is equal to 55 degrees, a frequency band width less than −10 dB is wide.

On the other hand, it will be assumed that it is required that the reflection coefficient S11 is −5 dB or less. In this event, it is understood that the reflection coefficient S11 is −5 dB or less in a frequency range between about 4 GHz and about 9 GHz when the angle θ is equal to any of 40 degrees, 45 degrees, 50 degrees, 55 degrees, and 60 degrees.

Figure 3:
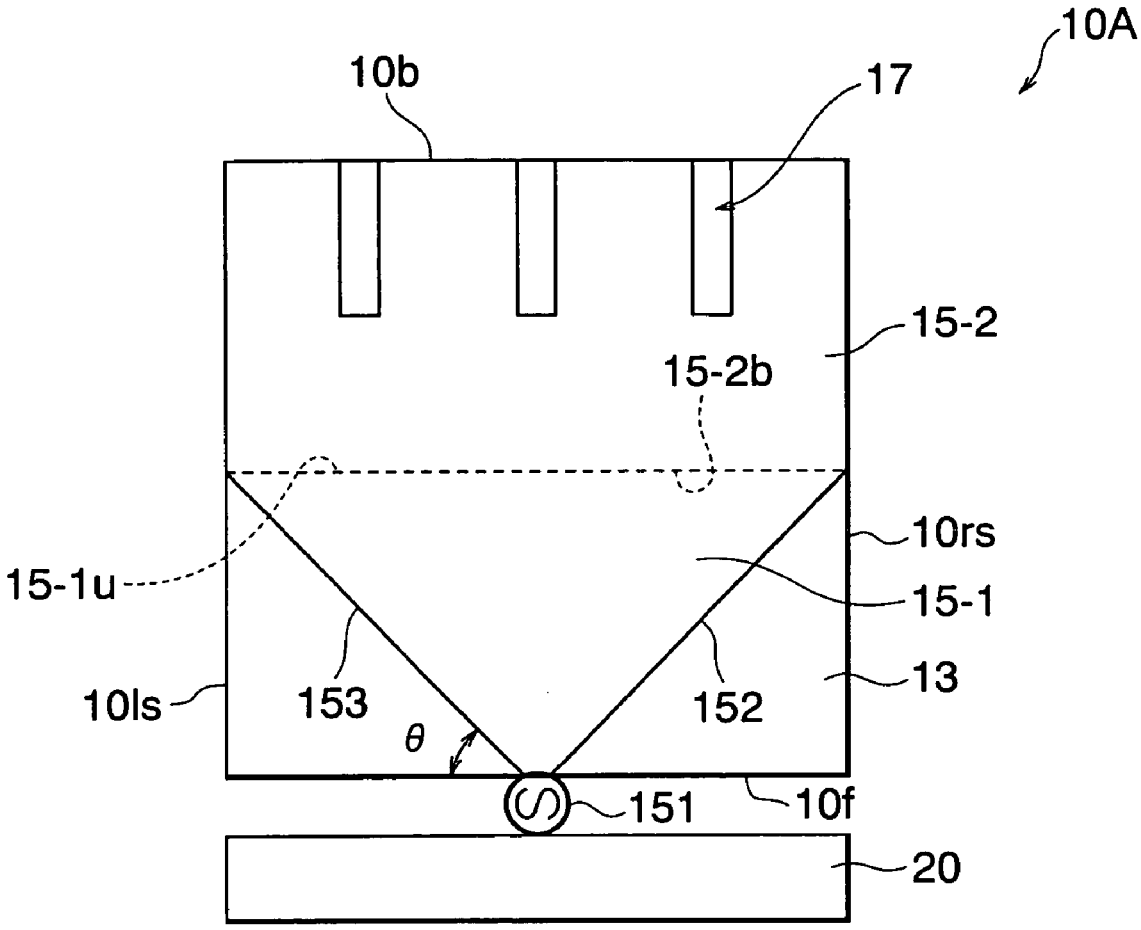
FIG. 3 is a transverse sectional plan view of an antenna unit according to a second embodiment of this invention.

Referring to FIG. 3, the description will proceed to a UWB antenna 10A as an antenna unit according to a second embodiment of the present invention. FIG. 3 is a transverse sectional plan view of the UWB antenna 10A.

The illustrated UWB antenna 10A is similar in structure to the UWB antenna 10 illustrated in FIGS. 1A and 1B except that the rectangular portion 15-2 has at least one slit 17 formed therein at the back surface 10*b*. In the example being illustrated in FIG. 3, the number of slits 17 is equal to three.

By forming the slits 17 in the rectangular portion 15-2, it is possible to improve a frequency characteristic of the UWB antenna 10A in the manner which will later be described.

Figure 4:
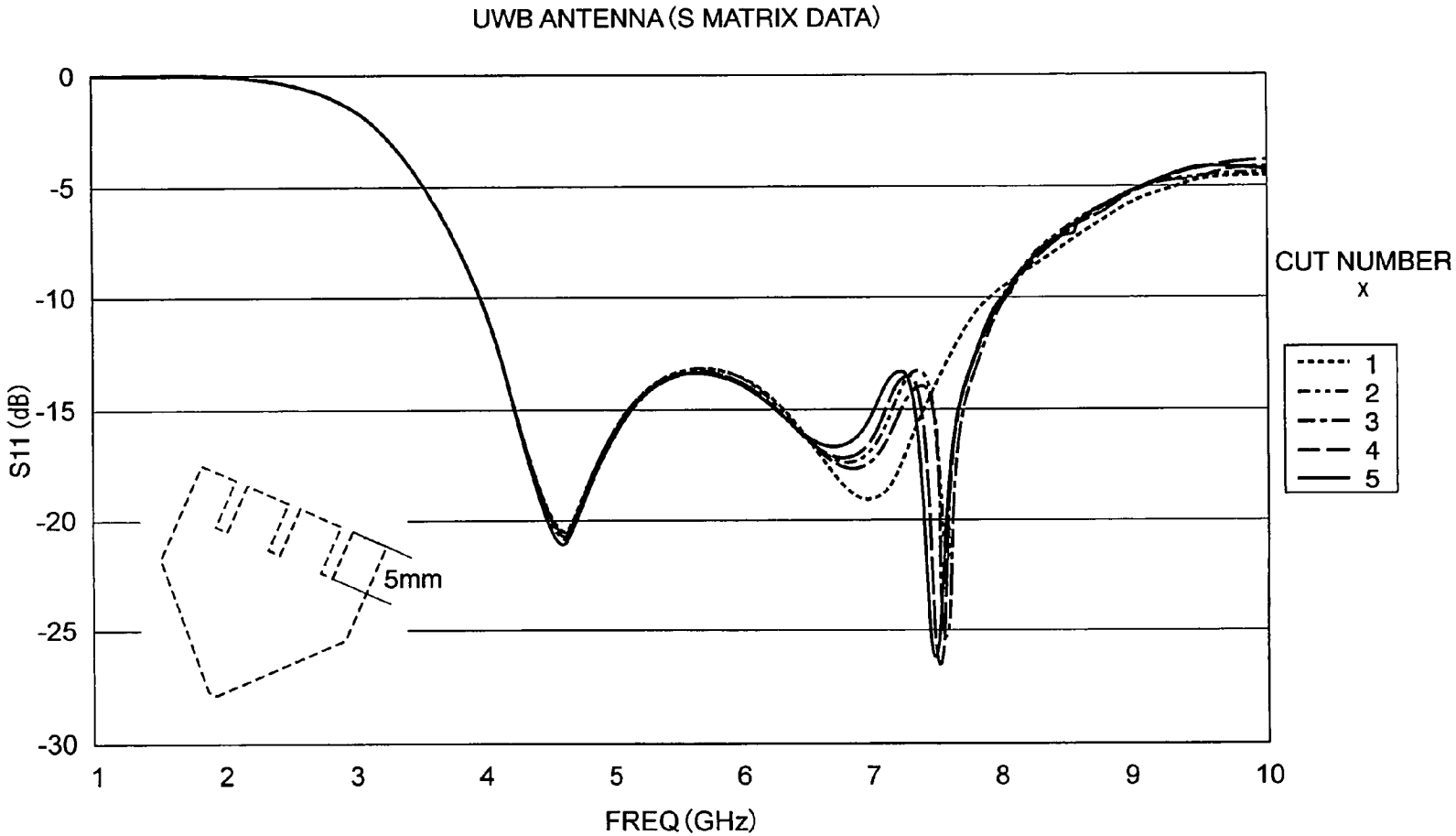
FIG. 4 is a characteristic view showing antenna characteristics when the number of slits (cut number) of the antenna unit illustrated in FIG. 3 is changed.

FIG. 4 shows antenna characteristics when the number of slits 17 (cut number) of the UWB antenna 10A illustrated in FIG. 3 is changed. In FIG. 4, the abscissa represents a frequency (GHz) and the ordinate represents the reflection coefficient S11 (dB) of the S parameters.

FIG. 4 shows the antenna characteristics of the UWB antenna 10A when the cut number is equal to one, two, three, four, and five with a depth (cut depth) of each slit 17 fixed to 5 mm. In addition, the angle θ is equal to 45 degrees.

From FIG. 4, it is understood that, compared with the UWB antenna 10 having no slit 17 (the angle θ is equal to 45 degrees in FIG. 2), the UWB antenna 10A having the slit or slits 17 has the reflection coefficient S11 where the frequency range of −10 dB or less is wider a little. Accordingly, it is possible to improve the frequency characteristic. When the cut number is equal to one, it is understood that the frequency range of −10 dB or less in the reflection coefficient S11 is narrowest. When the cut number is equal to any of two through five, it is understood that the frequency range of −10 dB or less in the reflection coefficient S11 is substantially equal to each other. Accordingly, it is preferable that the cut number is two or more.

Figure 5:
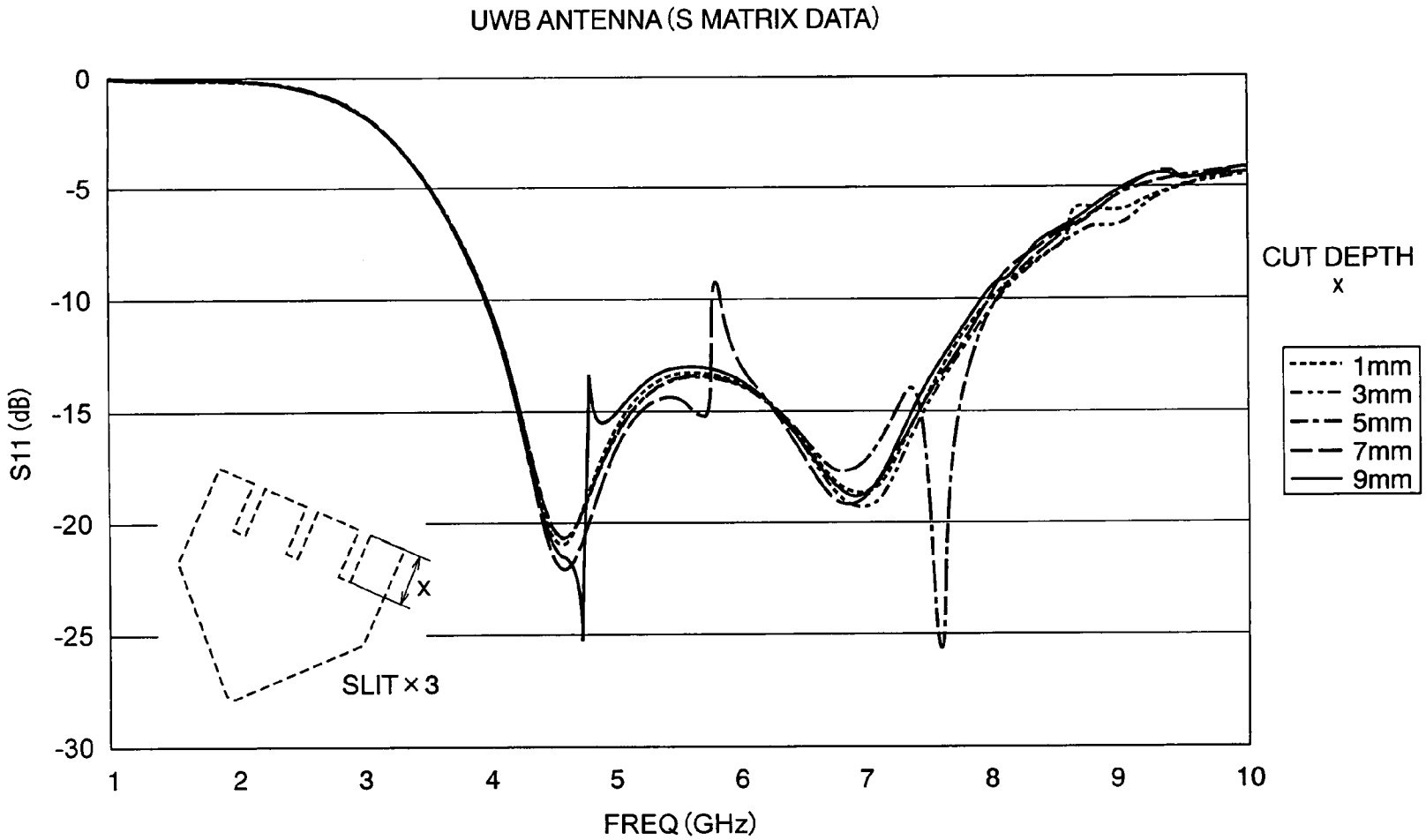
FIG. 5 is a characteristic view showing antenna characteristics when a depth of each slit (cut depth) of the antenna unit illustrated in FIG. 3 is changed.

FIG. 5 shows antenna characteristics when the depth of each slit 17 (cut depth) of the UWB antenna 10A illustrated in FIG. 3 is changed. In FIG. 5, the abscissa represents a frequency (GHz) and the ordinate represents the reflection coefficient S11 (dB) of the S parameters.

FIG. 5 shows the antenna characteristics of the UWB antenna 10A when the cut depth is equal to 1 mm, 3 mm, 5 mm, 7 mm, and 9 mm with the number (cut number) of the slits 17 fixed to three. In addition, the angle θ is equal to 45 degrees.

From FIG. 5, it is understood that the frequency range of −10 dB or less in the reflection coefficient S11 is widest when the cut number is equal to 3 mm or 5 mm and otherwise it is narrower a little. In addition, it is understood that the reflection coefficient S11 is partially −10 dB or more at a frequency of about 5.8 GHz when the cut number is equal to 7 mm. Accordingly, it is preferable that the cut depth lies a range between 3 mm and 5 mm.

Figure 6:
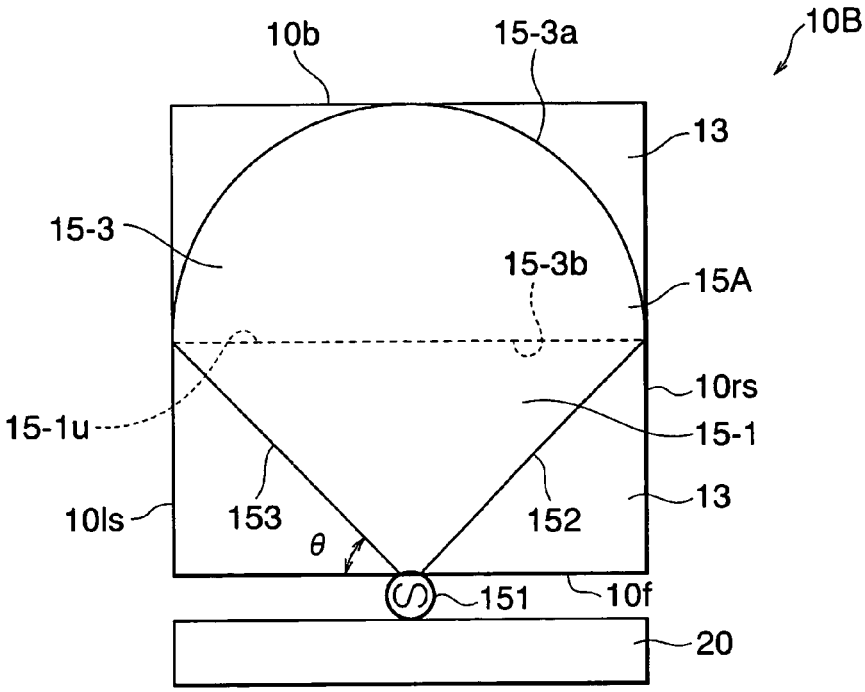
FIG. 6 is a transverse sectional plan view of an antenna unit according to a third embodiment of this invention.

Referring to FIG. 6, the description will proceed to a UWB antenna 10B as an antenna unit according to a third embodiment of the present invention. FIG. 6 is a transverse sectional plan view of the UWB antenna 10B.

The illustrated UWB antenna 10B is similar in structure to the UWB antenna 10 illustrated in FIGS. 1A and 1B except that the UWB antenna 10B comprises a conductive pattern 15A comprising a semicircular portion 15-3 in lieu of the rectangular portion 15-2.

The semicircular portion 15-3 has an arc 15-3*a* and a base side 15-3*b*. The base side 15-3*b* of the semicircular portion 15-3 is in contact with the upper side 15-1*u* of the reversed triangular portion 15-1.

The present co-inventors confirmed that the UWB antenna 10B has an antenna characteristic which is similar to that of the UWB antenna 10 illustrated in FIGS. 1A and 1B.

Figure 7:
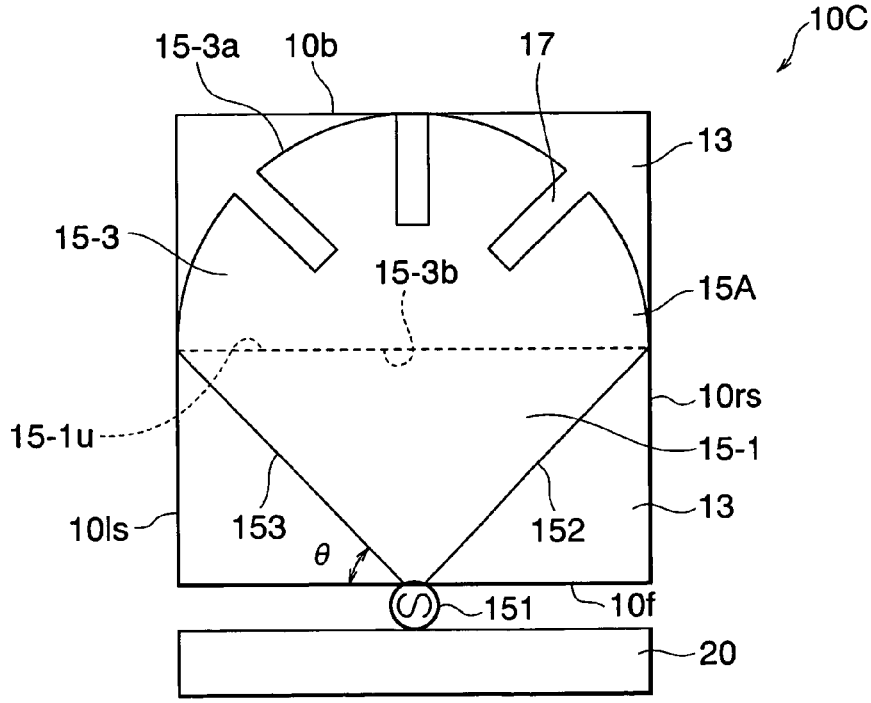
FIG. 7 is a transverse sectional plan view of an antenna unit according to a fourth embodiment of this invention.

Referring to FIG. 7, the description will proceed to a UWB antenna 10C as an antenna unit according to a fourth embodiment of the present invention. FIG. 7 is a transverse sectional plan view of the UWB antenna 10C.

The illustrated UWB antenna 10C is similar in structure to the UWB antenna 10A illustrated in FIG. 3 except that the UWB antenna 10C comprises the conductive pattern 15A comprising the semicircular portion 15-3 in lieu of the rectangular portion 15-2.

The semicircular portion 15-3 has the arc 15-3*a* and the base side 15-3*b*. The base side 15-3*b* of the semicircular portion 15-3 is in contact with the upper side 15-1*u* of the reversed triangular portion 15-1. In the UWB antenna 10C, the semicircular portion 15-3 has at least one slit 17 formed therein at the arc 15-3*a*. In the example being illustrated in FIG. 7, the number of slits 17 is equal to three.

The present co-inventors confirmed that the UWB antenna 10C has an antenna characteristic which is similar to that of the UWB antenna 10A illustrated in FIG. 3.

While this invention has thus far been described in conjunction with a few preferred embodiments thereof, it will now be readily possible for those skilled in the art to put this invention into various other manners.

What is claimed is:

1. An antenna unit comprising:

an upper dielectric;

a lower dielectric; and a conductive pattern sandwiched between said upper dielectric and said lower dielectric;

wherein said conductive pattern has a feeding point at a substantially central portion of a front thereof, and said conductive pattern comprises:

a reversed triangular portion including a right-hand taper part and a left-hand taper part which widen from the feeding point at a predetermined angle toward a right-hand side and a left-hand side, respectively; and a rectangular portion including a base side in contact with an upper side of said reversed triangular portion;

wherein said rectangular portion has at least two slits formed therein.

2. The antenna unit as claimed in claim 1, wherein said predetermined angle is in a range of 40 degrees to 60 degrees.

3. An antenna unit comprising:

an upper dielectric;

a lower dielectric; and a conductive pattern sandwiched between said upper dielectric and said lower dielectric;

wherein said conductive pattern has a feeding point at a substantially central portion of a front thereof, and said conductive pattern comprises:

a reversed triangular portion including a right-hand taper part and a left-hand taper part which widen from the feeding point at a predetermined angle toward a right-hand side and a left-hand side, respectively; and a semicircular portion including a base side in contact with an upper side of said reversed triangular portion;

wherein said semicircular portion has at least one slit formed therein.

4. The antenna unit as claimed in claim 3, wherein said semicircular portion has at least two slits formed therein.

5. The antenna unit as claimed in claim 3, wherein said predetermined angle is in a range of 40 degrees to 60 degrees.

* * * * *

UNITED STATES PATENT AND TRADEMARK OFFICE

CERTIFICATE OF CORRECTION

PATENT NO. : 7,081,859 B2
APPLICATION NO. : 10/874910
DATED : July 25, 2006
INVENTOR(S) : Akira Miyoshi It is certified that error appears in the above-identified patent and that said Letters Patent is hereby corrected as shown below:

Column 7, before line 1, insert --from the feeding point at a predetermined angle--.

Signed and Sealed this

Twenty-fourth Day of June, 2008

JON W. DUDAS
*Director of the United States Patent and Trademark Office*